US005730612A

United States Patent [19]

Tatsuzuki

[11] Patent Number: 5,730,612

[45] Date of Patent: Mar. 24, 1998

[54] COAXIAL CONNECTOR WITH BUILT-IN TERMINAL

[75] Inventor: Kazumi Tatsuzuki, Ibaragi, Japan

[73] Assignee: Nippon Antenna Company Ltd., Tokyo, Japan

[21] Appl. No.: 614,490

[22] Filed: Mar. 13, 1996

[30] Foreign Application Priority Data

Dec. 8, 1995 [JP] Japan ..... 7-345090

[51] Int. Cl.[6] ..... H01R 29/00

[52] U.S. Cl. ..... 439/188; 439/944

[58] Field of Search ..... 200/51.1; 439/188, 439/944, 620, 76.1

[56] References Cited

U.S. PATENT DOCUMENTS 5,030,122 7/1991 Birch et al. ..... 439/188

5,076,797 12/1991 Moulton ..... 200/51.1

5,090,915 2/1992 Moulton ..... 200/51.1

5,237,293 8/1993 Kan et al. ..... 439/188

*Primary Examiner*—Neil Abrams

*Assistant Examiner*—Barry M. L. Standig

*Attorney, Agent, or Firm*—Pollock, Vande Sande & Priddy

[57] ABSTRACT

A coaxial connector with a built-in terminal does not cause a disturbance even when it is left as a blank terminal. A switch terminal block contained and disposed in a central contact is elastically clamped by a first spring and a second spring; it is in contact with a switch contact section of a printed circuit board. This allows the central contact to be terminated with a chip resistor on the printed circuit board. When a coaxial plug is attached to the coaxial connector, the central conductor of the coaxial plug compresses the first spring and the second spring to cause the switch terminal block to slide off the switch contact section.

4 Claims, 16 Drawing Sheets

COAXIAL CONNECTOR C

COAXIAL CONNECTOR WITH BUILT-IN TERMINAL

BACKGROUND OF THE INVENTION

1. Field of the Invention

The present invention relates to a coaxial connector which is employed as an input terminal or an output terminal of a distributor, a branching filter, or the like for transmitting electric signals in a cable television (CATV) or the like and to which a coaxial plug provided on the distal end of a coaxial cable is connected.

2. Description of the Related Art

A coaxial plug, which is connected to receiving equipment such as a television set via a coaxial cable, is attached to a coaxial connector used for the input/output terminal of the equipment for transmitting this type of electric signals. When no receiving equipment is provided for the output terminal of the equipment for transmitting the electric signals, the coaxial plug is removed, thus leaving a "blank" terminal.

In the case of television retransmission which is frequently performed for home community receiving systems or for community receiving systems involving radio disturbance or the like, there signals are hardly ever transmitted to an adjacent channel; therefore, leaving a blank terminal scarcely causes disturbances or the like to another television which is installed.

However, in the case of multi-channel transmission and a CATV system such as a bilateral CATV which have been introduced in recent years, many channels are used and signals are transmitted to adjacent channels. For this reason, leaving blank terminals causes disturbance or the like in another television installed as described below.

The disturbance problem will be described with reference to prior art FIG. 13 and FIG. 14. As shown in FIG. 13, if terminal B of a bi-distributor 2000 is left as a blank terminal, then the voltage stationary wave ratio (VSWR) in the direction of the arrow, which is the direction of terminal B, becomes infinite, and therefore the reflected waves from terminal B cause phase shifts in signals with resultant deterioration in the signals. This leads to ghost images in television or the like which is connected to terminal A. The phase shifts also provoke fluctuations in the amplitude and consequent deteriorated frequency response and some channels are therefore likely to incur disturbance.

In the case of BS/CS-IF transmission, satellite broadcasting signals are frequency-modulated; therefore, such problems as the occurrence of truncation noises and poor energy dispersal control occur. The CATVs incur the same problems because they also employ frequency modulation.

Further, as illustrated in prior art FIG. 14, if terminal B of the bi-distributor 2000 of the bilateral CATV system is left blank with the coaxial core wire exposed, then the coaxial core wire draws external noises and the noises drawn to the blank terminals of many terminal devices are combined and the noises move up toward the center. The noises are called merged noises. The noises are, however, not only drawn to the coaxial core wires but also to the coaxial cables themselves and the noises which come from many coaxial cables and which are combined also produce a merged noise. The merged noise prevents the use of uplink in the case of bidirectional communication.

FIG. 15 shows the reflection loss characteristic observed when the output terminal of a series unit is a blank terminal and that observed when it is terminated with a dummy resistor. When the output terminal is terminated with the dummy resistor, a reflection loss of approximately 20 dB or more is obtained over the full frequency band as shown by curve A in the graph, whereas a reflection loss of only approximately 15 dB is obtained as shown by curve B when the output terminal is left as a blank terminal.

FIG. 16 shows the reflection loss characteristic observed when four-tap-off output terminals are left as blank terminals and that observed when they are terminated with dummy resistors. A reflection loss of about 20 dB or more is observed over the full frequency band as indicated by curve A when the four terminals are terminated with the dummy resistors, whereas the reflection loss characteristic significantly deteriorates as indicated by curve B when one terminal is left as a blank terminal, or a reflection loss of only approximately 15 dB is observed as indicated by curve C when two terminals are left as blank terminals. When three terminals are left as blank terminals, a reflection loss of only about 12 dB is obtained as indicated by curve D. When all the four terminals are left as blank terminals, a reflection loss of only about 8 dB is obtained.

Therefore, blank terminals are provided with dummy plugs to prevent the disturbance stated above. Such a dummy plug has been disclosed in, for example, Japanese Utility Model No. 6-17363. The dummy plug will be described in conjunction with prior art FIG. 17. In the drawing, a dummy plug 01 is constructed by a central contact 02, a dummy resistor 03 for matching to the characteristic impedance of a coaxial cable, a shell 04, a soldering section 05 for connecting the dummy resistor 03 to the shell 04, and a connecting nut 06. When the dummy plug 01 is attached to a coaxial connector, not shown, an electric signal, which has been transmitted, flows into the central contact 02 of the dummy plug 01 via the central contact of the coaxial connector and it is grounded to the main body of the coaxial connector via the dummy resistor 03, the soldering section 05, the shell 04, and the connecting nut 06. Thus, the reflection of electric signals and the invasion of external noises are prevented by terminating a blank terminal with the dummy resistor 03 of the dummy plug 01.

However, when the coaxial plug connected to receiving equipment is detached from the output terminal of the equipment for transmitting electric signals, the dummy plug 01 is not always attached to the blank output terminal. Especially in case of general household appliances, very few people think of attaching the dummy plug 01 to a blank terminal because they are not aware of the need for attaching the dummy plug 01 to any blank terminal of their household appliances.

SUMMARY OF THE INVENTION

Accordingly, it is an object of the present invention to provide a coaxial connector with a built-in terminal which may be used for the output terminal of such equipment as a distributor and a branching filter for transmitting electric signals and which does not cause a disturbance even if it is left as a blank terminal.

Another object of the present invention is to provide a coaxial connector with a built-in terminal which can be used for coaxial plugs having different sizes of central conductors.

In a first embodiment of the invention, there is provided a coaxial connector with a built-in terminal characterized in that it is equipped with a connector main body which is approximately cylindrical in shape, a central contact wherein electrical signals are input, an insulator which serves to fix the said central connector to the said connector main body in such a manner that the said central contact is located on roughly the central axis of the said connector main body, a dummy consisting of a printed circuit board located within the said connector main body in such a manner that the said central contact fits into an inserting hole which is formed in roughly the center thereof and intersects at roughly right-angles with the central axis of the said connector main body, a contact provided on the said printed circuit board, and an electrical element, a switch terminal block located within the said central contact in such a manner as to be capable of movement along roughly the central axis of the said central contact, and an elastic member located within the said central contact in such a manner as to terminate the said central contact with the aid of the said dummy by energizing the said switch terminal block so as to bring a projection of the said switch terminal block into contact with the said contact of the said printed circuit board, the said elastic member being compressed by a central conductor of a coaxial plug at such time as the said coaxial plug is inserted into the said connector main body, in such a manner that the said switch terminal block slides and the contact between the said contact of the said printed circuit board and the said switch terminal block is severed.

Moreover, in the abovementioned first embodiment, the coaxial connector with built-in terminal may be configured in such a manner that, by forming a conductive foil over the whole surface of the said printed circuit board and allowing this to act as a ground contact section, the said printed circuit board also functions as a shield plate.

Furthermore, in the abovementioned first embodiment, the coaxial connector with built-in terminal may be configured in such a manner that the said printed circuit board is held within the said connector main body by means of a stepped section formed on the inner surface of the said connector main body and the distal end of the said insulator, the said ground contact section which is formed on the said printed circuit board coming into electrical contact with the said stepped section.

In a second embodiment of the invention, there is provided a coaxial connector with a built-in terminal characterized in that it is equipped with a connector main body which is approximately cylindrical in shape, a central contact wherein electrical signals are input, an insulator which serves to fix the said central connector to the said connector main body in such a manner that the said central contact is located on roughly the central axis of the said connector main body, a dummy consisting of a printed circuit board located so as to be capable of sliding within the said connector main body in such a manner that the said central contact fits into an inserting hole which is formed in roughly the center thereof and intersects at roughly right-angles with the central axis of the said connector main body, a contact provided on the said printed circuit board, and an electrical element, a contact piece located on the said central contact in such a manner as to come into contact with a contact section formed in the said inserting hole of the said printed circuit board, an elastic member which serves to terminate the said central contact with the aid of the said dummy by energizing the said printed circuit board, which is capable of sliding along roughly the central axis of the said connector main body, in such a manner as to bring a ground contact section of the said printed circuit board into electrical contact with a stepped section formed on the said connector main body, and an insertion guide insulator located in a sliding fashion within the said connector main body in such a manner that its distal end protrudes from the said connector main body while its trailing end is brought into contact with the said printed circuit board, being configured in such a manner that at such time as a coaxial plug is inserted into the said connector main body, the said printed circuit board is caused to slide by virtue of the trailing end of the said insertion guide insulator, which slides within the said connector main body, and the contact between the said ground contact section of the said printed circuit board and the said stepped section of the said connector main body is severed.

According to the present invention, when no coaxial plug is attached to the coaxial connector, the central contact is electrically connected to the printed circuit board, so that the electrical signal entered through the central contact passes through the dummy provided on the printed circuit board and it is transmitted to the connector main body of the coaxial connector before it is grounded. Thus, the coaxial connector with the built-in terminal is always terminated with the dummy even if it is left as a blank terminal; therefore, it does not cause a disturbance.

Connecting the coaxial plug to the coaxial connector, left as the blank terminal, cuts off the electrical connection between the central contact and the connector main body and the circuit terminating the electric signal is cut off. Furthermore, the central contact of the coaxial connector is connected to the central conductor of the coaxial plug and therefore, the electrical signal applied to the central contact of the coaxial connector is applied to the coaxial plug via the central conductor of the coaxial plug.

DESCRIPTION OF THE PREFERRED EMBODIMENTS

Figure 1:
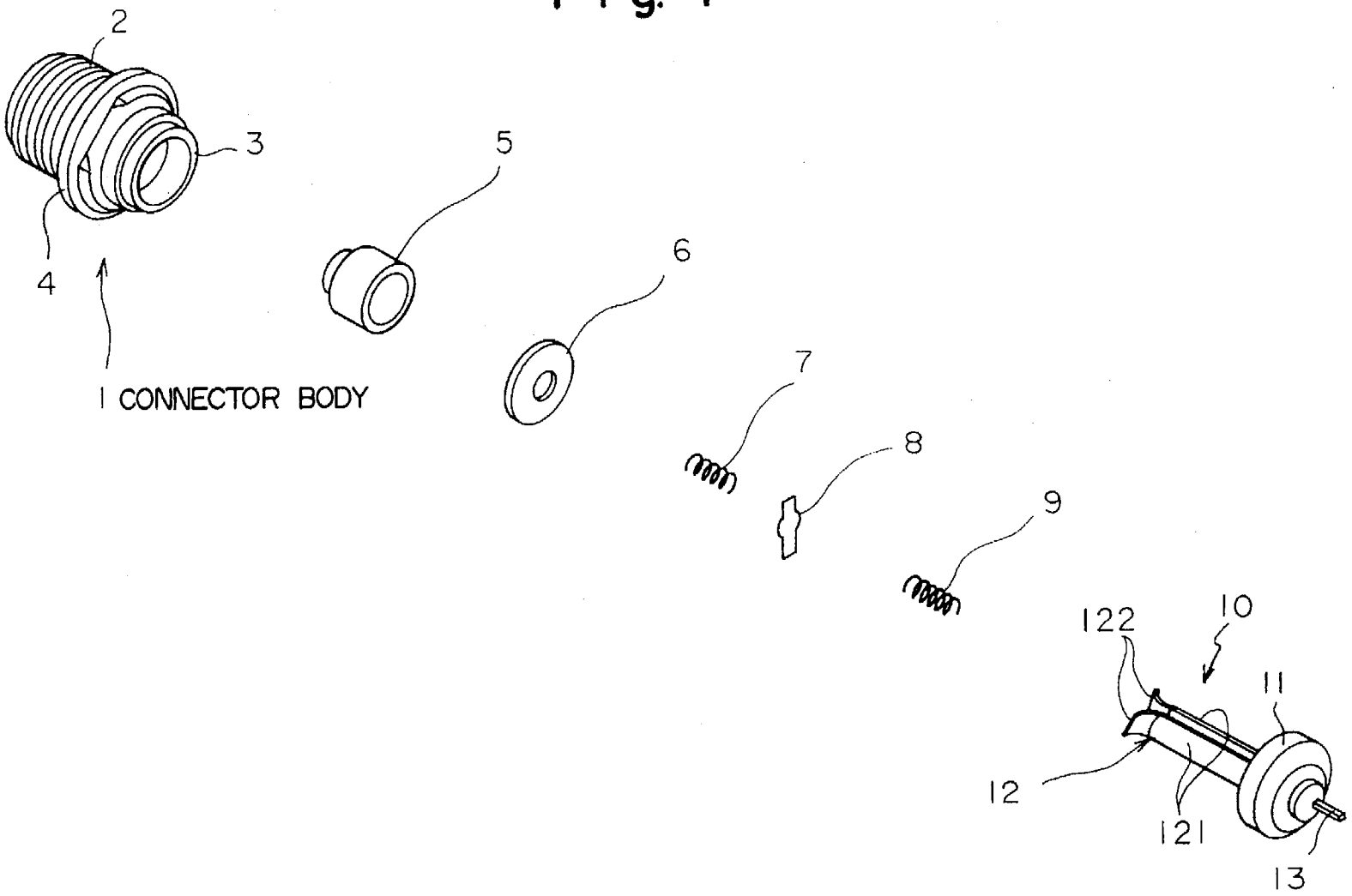
FIG. 1 is an exploded perspective view illustrating a coaxial connector with a built-in terminal in accordance with a first embodiment of the present invention.

The first embodiment of the coaxial connector with the built-in terminal according to the present invention will be described with reference to FIG. 1 through FIG. 5.

In the drawings, coaxial connector C with the built-in terminal is attached to equipment, e.g. a distributor, for transmitting an electric signal. P denotes a coaxial plug which is connected to coaxial connector C with the built-in terminal. Coaxial 0 connector C with the built-in terminal includes: a connector main body 1 comprised of an approximately cylindrical, conductive metal piece; an external thread 2 which is formed on the outer surface of the connector main body 1 and on which coaxial plug P is screwed on; a crimped section 3 which is formed on the bottom end of the connector main body 1 and which is crimped to fix the internal components after the components are put in the connector main body 1; and a jaw 4 which is formed on the outer periphery of the connector main body 1 and which is applied to a mounting body 20.

Coaxial connector C further includes: a resinous insertion guide insulator 5; a disc-shaped dummy 6 which is disposed nearly perpendicularly to a central contact 12; a first spring 7 inserted in the central contact 12; a switch terminal block 8 which is made of a conductive metal and the central part of which is disposed in the central contact 12, both ends of which jut out of the central contact 12; and a second spring 9 which elastically holds the switch terminal block 8 with the first spring 7 and which is inserted in the central contact 12.

A central conductor 10 is made of a conductive metal; it has the central contact 12 on one end thereof and a connecting terminal 13 on the other end thereof. A resinous insulator 11 is attached to the central conductor 10 to dispose the central conductor 10 on the central axis of the connector main body 1. When coaxial plug P is attached to coaxial connector C with the built-in terminal, the central conductor of coaxial plug P is inserted in the central contact 12 which incorporates the first spring 7, the switch terminal block 8, and the second spring 9.

The connecting terminal 13 is connected by soldering to a circuit board of a distributor or the like which is not shown. Reference numeral 14 denotes a ground contact section which is formed by a conductive thin film 41 on one surface of a printed circuit board 61 and which contacts the connector main body 1. Reference numeral 15 denotes an annular switch contact section which is formed by a conductive thin film 151 on the other surface of the printed circuit board 61 and which constitutes a switch with the projection of the switch terminal block 8. A chip resistor 16 constitutes a part of the dummy 6 soldered onto the printed circuit board 61 and provides the same resistance value, e.g. 75 ohms, as the characteristic impedance of a coaxial cable. A chip capacitor 17 constitutes the part of the dummy 6 soldered onto the printed circuit board 61. Reference numeral 18 denotes a section which is crimped to attach coaxial connector C with the built-in terminal to the mounting body 20 of a branching filter or the like. Reference numeral 19 denotes a hook for firmly fixing the central conductor 10 onto the insulator 11. Coaxial connector C with the built-in terminal is attached to the mounting body 20 of a distributor or the like.

The central contact 12 of the central conductor 10 is comprised of two elastic strips 121 which face against each other; the distal ends 122 thereof are diverged to permit easy insertion of the central conductor 510 of coaxial plug P. The first spring 7, the switch terminal block 8, and the second spring 9 follow the distal ends 122. The central contact 12 is bent in cross section as shown in FIG. 5(*d*) to enhance the elasticity.

The incorporated switch terminal block 8 has both ends thereof jutting out of the central contact 12 and it is clamped between the first spring 7 and the second spring 9; it is urged so that it is positioned approximately at the centers of the first spring 7 and the second spring 9. The projecting ends 81 constitute, together with the switch contact section 15 formed on the printed circuit board 61, the switch as it will be discussed later.

As the resinous insulator 11 is press-fitted from the connecting terminal 13 of the central conductor 10 equipped with the central contact 12 thus configured, the hook 19 formed on the central conductor 10 bites into the insulator 11 as shown in FIG. 5(*e*), thus making firm engagement between the central conductor 10 and the insulator 11.

As illustrated in FIG. 1, the second spring 9, the switch terminal block 8, and the first spring 7 are inserted in the central contact 12 in the order in which they are listed so as to assemble the central conductor 10.

In the next step, the insertion guide insulator 5 is inserted in the connector main body 1 from the side where the crimped section 3 is formed, then the dummy 6 is inserted, and the central conductor 10 which has been assembled is inserted so that it passes through the central hole in the printed circuit board 61.

Figure 2:
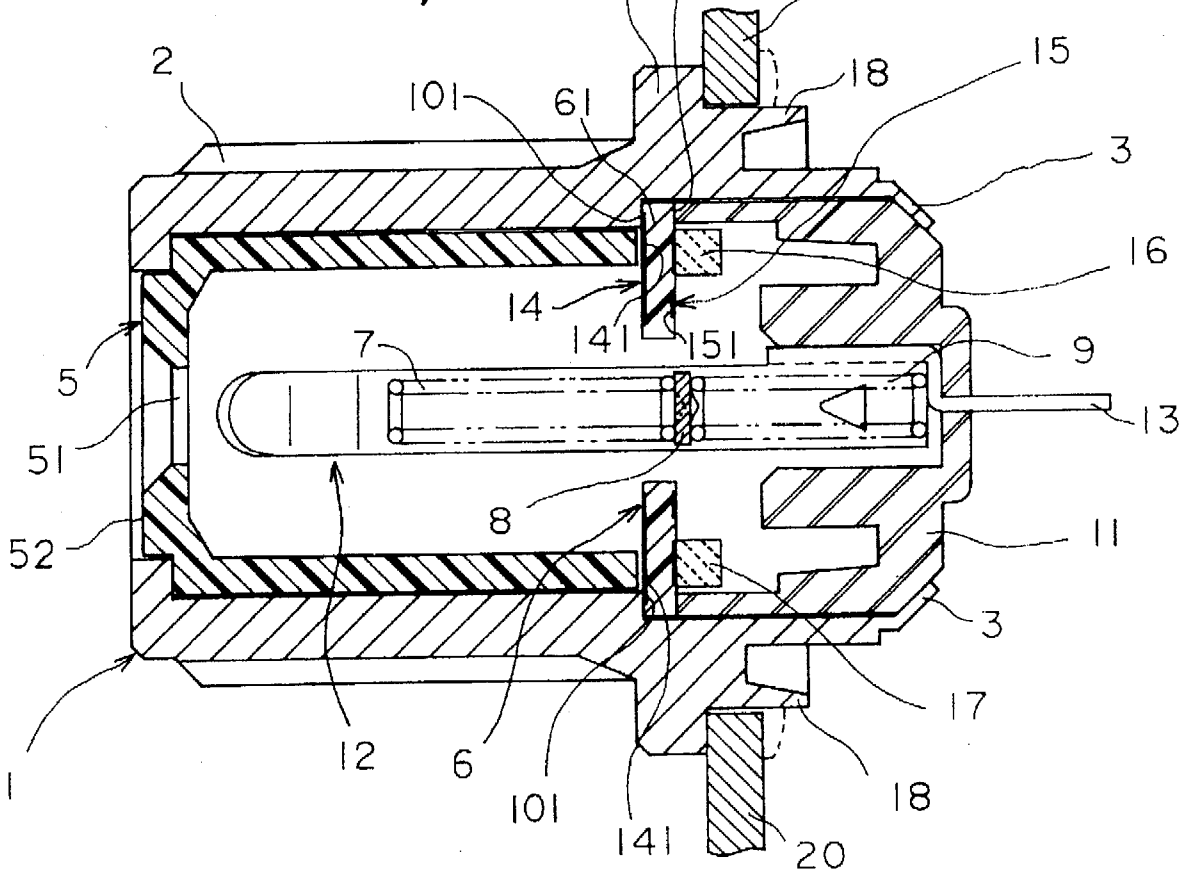
FIG. 2 is a cross-sectional view illustrating the coaxial connector with the built-in terminal in accordance with the first embodiment of the present invention.
Figure 3:
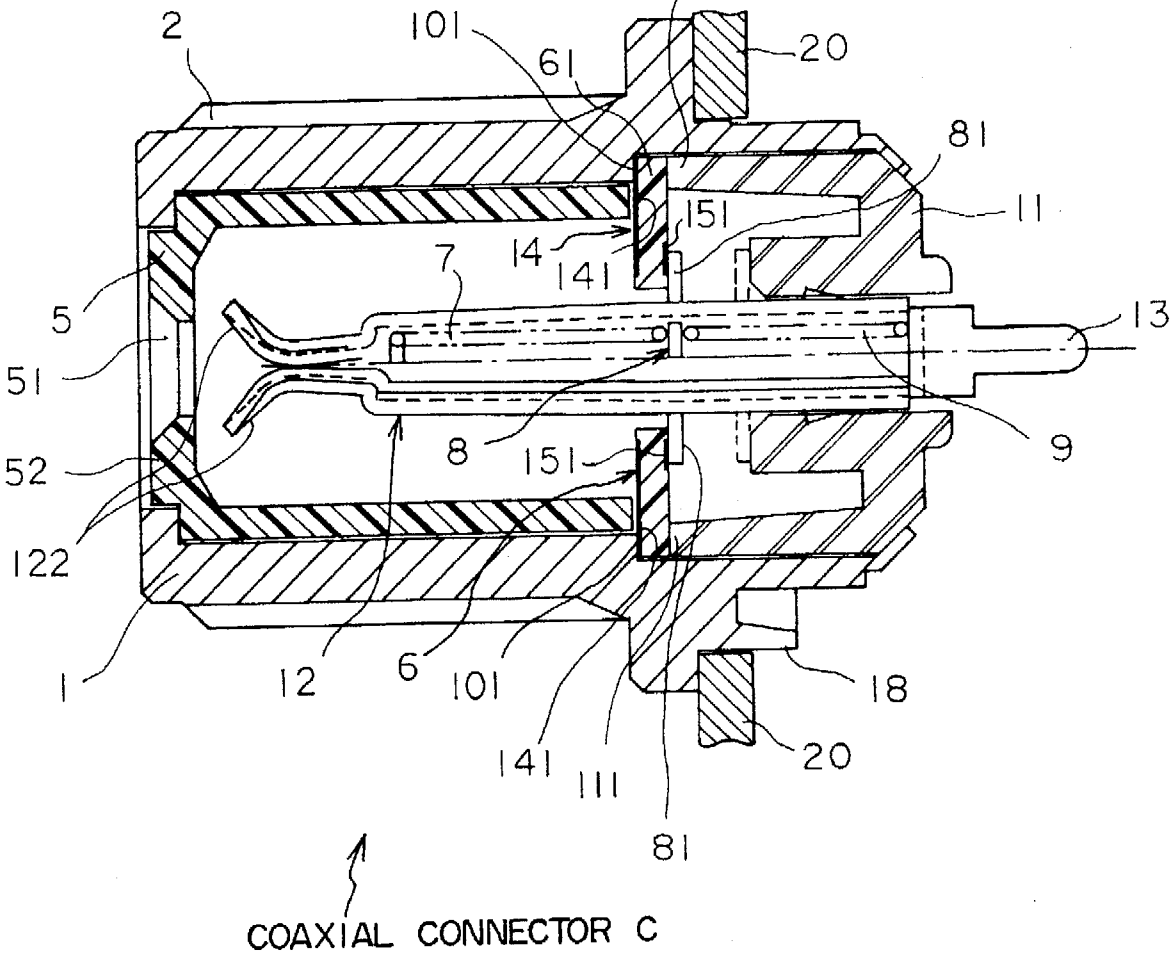
FIG. 3 is a cross-sectional view illustrating the coaxial connector with the built-in terminal in accordance with the first embodiment of the present invention observed from a direction which is 90 degrees shifted from that of FIG. 2.

Crimping the section 3 holds the printed circuit board 61 between the distal end of the insulator 11 and the stepped section 101 formed inside the connector main body 1 as illustrated in FIG. 2 and FIG. 3, thus making electrical connection between the ground contact section 14, which is formed on the printed circuit board 61, and the connector main body 1. The distal end 22 of the central contact 122 is so positioned that it follows the guide hole 51 for guiding the central conductor 510 (FIG. 4) of coaxial plug P' formed on the distal end 52 of the insertion guide insulator 5.

Further, the action of the first spring 7 and the second spring 9 makes electrical contact between the projection of the switch terminal block 8, which is inserted in the central contact 12, and the annular switch contact section 15 which is formed on the printed circuit board 61.

Thus, when coaxial connector C with the built-in terminal is not provided with coaxial plug P and left as a blank terminal, the central contact 12 is connected to the connector main body 1 via the series circuit of the chip resistor 16 and the chip capacitor 17 soldered to the printed circuit board 61 through the switch terminal block 8 and the switch contact section 15.

Coaxial connector C with the built-in terminal is attached to the metallic mounting body 20 of the enclosure or the like of the branching filter by crimping the section 18 of the body as illustrated by the dashed line in FIG. 2; therefore, the central contact 12 is terminated with the dummy 6 having the characteristic impedance of the coaxial cable. This prevents the reflection or the entry of external noises which are attributable to coaxial connector C with the built-in terminal.

Figure 4:
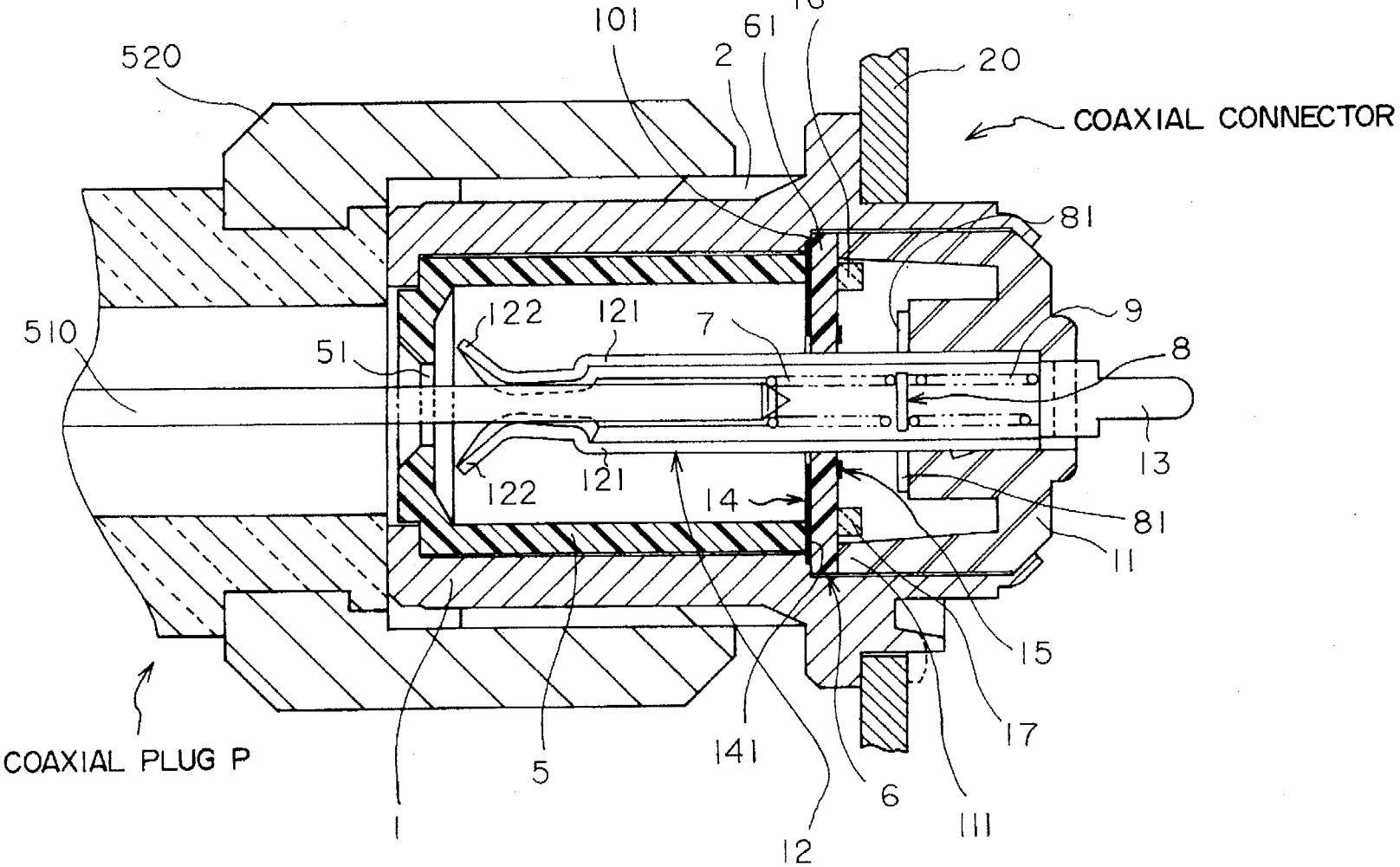
FIG. 4 is a cross-sectional view illustrating a coaxial plug coupled to the coaxial connector with the built-in terminal shown in FIG. 3.
Figure 5A:
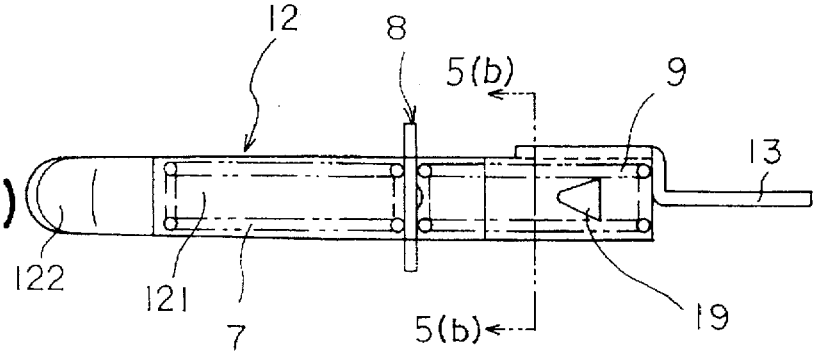
FIGS. 5(*a*)–5(*e*) are diagrams illustrating the details of the central conductor of the coaxial connector with the built-in terminal according to the first embodiment of the present invention.
Figure 5B:
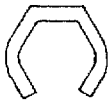
Figure 5C:
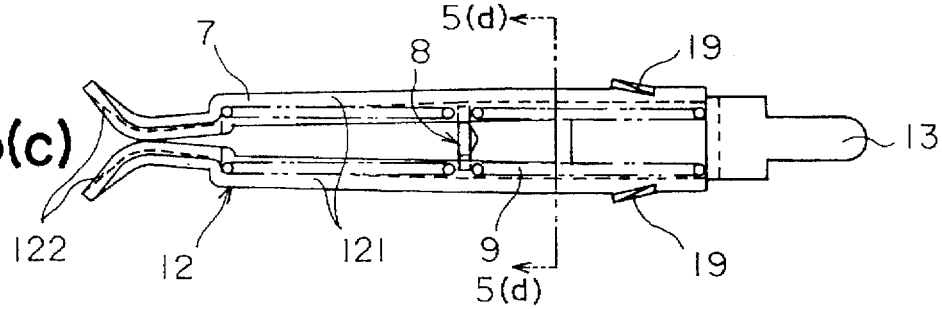
Figure 5D:
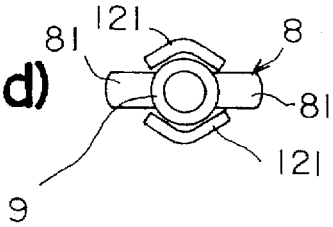
Figure 5E:
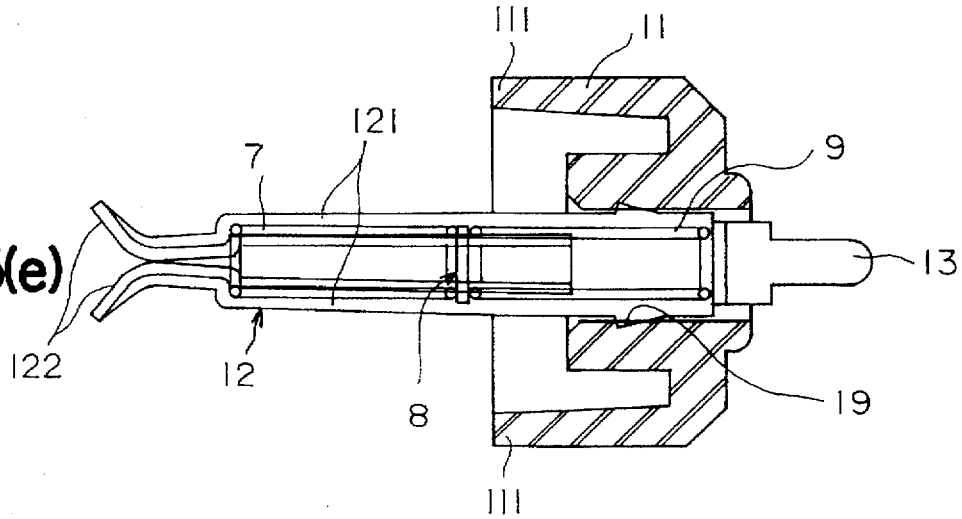
Figure 6:
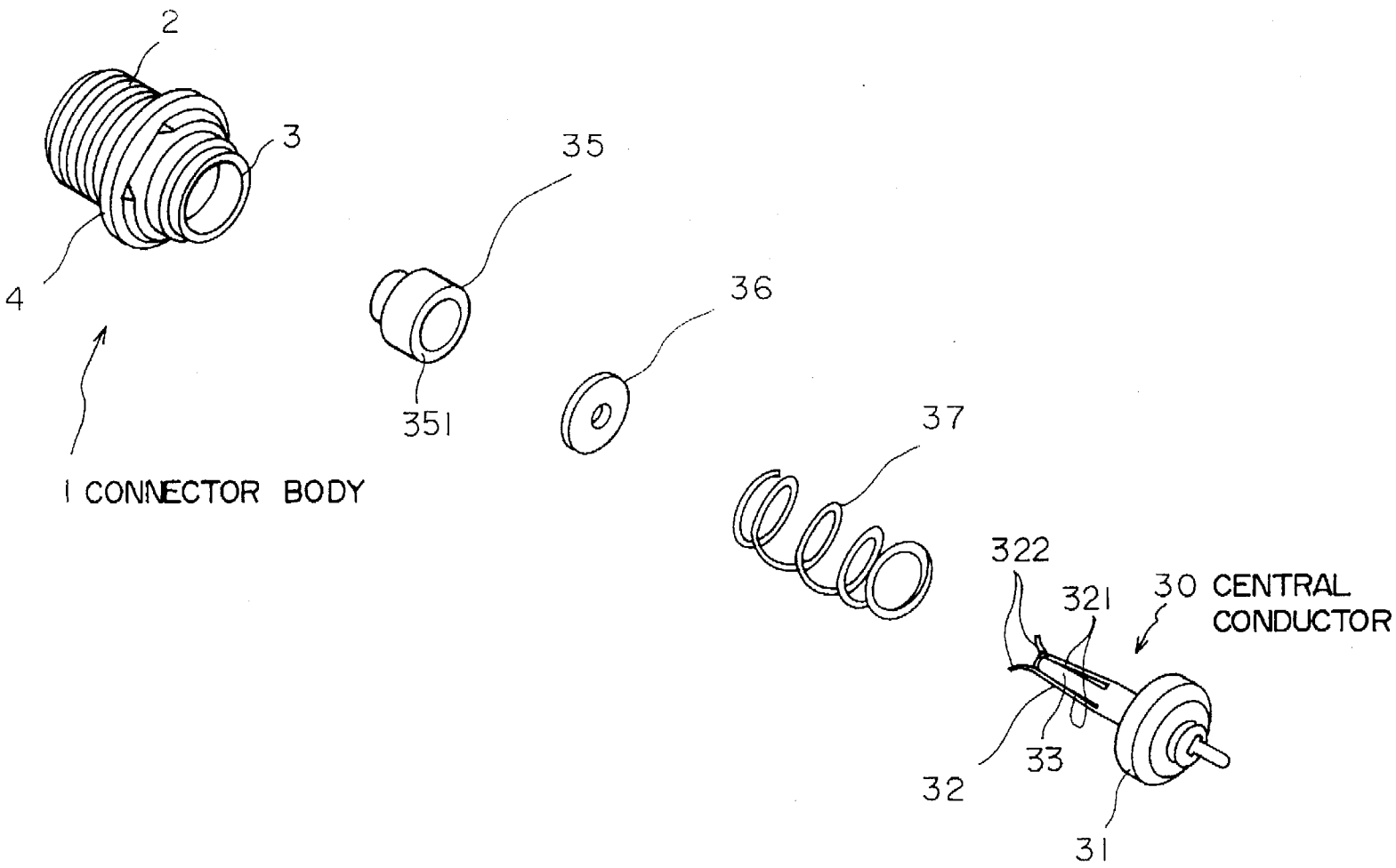
FIG. 6 is an exploded perspective view illustrating a coaxial connector with a built-in terminal in accordance with a second embodiment of the present invention.

To connect coaxial plug P so as to use coaxial connector C with the built-in terminal left as the blank terminal, the internal thread formed on the inner periphery of a connecting nut 520 of coaxial plug P is screwed to the external thread 2 of coaxial connector C with the built-in terminal as illustrated in FIG. 4. This causes a central conductor 510 of coaxial plug P to be guided by the guiding hole 51 of the insertion guide insulator 5 so that it is inserted in the central contact 12 of coaxial connector C with the built-in terminal, making electrical connection to the central contact 12. Thus, the signals from coaxial plug P are guided to a distributor or the like via coaxial connector C with the built-in terminal.

At this time, the first spring 7 contained in the central contact 12 of coaxial connector C with the built-in terminal is compressed in contact with the central conductor 510 of coaxial plug P.

Hence, the first spring 7 and the second spring 9 are compressed and displaced and the switch terminal block 8, which is clamped between the first spring 7 and the second spring 9, moves toward the connecting terminal 13, releasing the contact between the switch terminal block 8 and the switch contact section 15. This in turn releases the contact between the central contact 12 and the dummy 6 comprised of the chip resistor 16 and the chip capacitor 17.

Detaching coaxial plug P from coaxial connector C with the built-in terminal releases the first spring 7 and the second spring 9, which have been compressed and displaced, and the switch terminal block 8 clamped between the first spring 7 and the second spring 9 moves toward the printed circuit board 61. This causes the switch terminal block 8 and the switch contact section 15 to come in contact again, with the consequent blank terminal terminated with the aforesaid dummy 6.

As previously stated, the central contact 12 is comprised of two elastic strips 121 facing against each other and bent in cross section. This feature makes it possible to accommodate various diameters of the central conductor of coaxial plug P to be attached. The first embodiment (See FIGS. 1–5(*e*) in accordance with the present invention is adaptable to the central conductor of coaxial plug P having a diameter of about 0.5 mm to about 1.5 mm.

The second embodiment of the coaxial connector with the built-in terminal in accordance with the present invention will now be described in conjunction with FIG. 6 through FIG. 11.

In the description of the second embodiment, the same parts as those of the first embodiment will be denoted by the same reference numerals and the description thereof will be omitted.

The connector main body 1 of the second embodiment includes a central conductor 30 which is made of a conductive metal and which has a central contact 32 formed on one end thereof and a connecting terminal 43 formed on the other end thereof; a resinous insulator 31 which is mounted on the central conductor 30 to position the central conductor 30 on the central axis of the connector main body 1; a central contact 32 which is comprised of two opposing elastic strips 321 and into which the central conductor of coaxial plug P is inserted when coaxial plug P is attached to coaxial connector C with the built-in terminal; a contact piece 33 which is approximately orthogonal to the central contact 12 and which is urged outward; a resinous insertion guide insulator 35, the front of which juts out of the connector main body 1 and the trailing end of which contacts a printed circuit board 361 when it is mounted; a dummy 36 which is disposed approximately perpendicularly to the central contact 32 and which is a movable disc-shaped element; and a spring 37 which urges the printed circuit board 361 and also urges the insertion guide insulator 35 so that it juts out.

The second embodiment further includes a solder connection between connecting terminal 43 and the circuit board of a distributor or the like which is not shown; a ground contact section 44 which is formed by a conductive thin film 441 on one surface of the printed circuit board 361 and which contacts the connector main body 1; a contact section 45 which is formed by a conductive thin film 451 on the inserting hole 362 made at the center of the printed circuit board 361 and which is always in contact with the contact piece 33; a chip resistor 46 which constitutes part of the dummy 36 soldered onto the printed circuit board 361 and which provides the same resistance value, e.g. 75 ohms, as the characteristic impedance of a coaxial cable; a chip capacitor 47 which another part of the dummy 36 soldered onto the printed circuit board 361; a section 48 which is crimped to attach coaxial connector C with the built-in terminal to the mounting body 20 of a distributor or the like; and a hook 49 see FIGS. 10(*c*) and 10(*e*) for firmly fixing the central conductor 30 onto the insulator 31.

The central contact 32 which extends in one direction of the central conductor 30 is comprised of two elastic strips 321 as illustrated in FIG. 10; the distal ends 322 thereof are diverged to permit easy insertion of the central conductor of coaxial plug P, and the elastic strips 321 beyond the distal ends 322 are bent in cross section as shown in FIG. 10(*d*) to enhance the resiliency.

Two opposing contact pieces 33 are made of elastic strips 321; they are disposed so that they are approximately orthogonal to the central contact 32. The contact pieces 33 are urged to spread outward. When the central contact 32 and the contact pieces 33 are inserted in the inserting hole 362 of the printed circuit board 361, the contact piece 33 electrically contact the contact section 45 formed in the inserting hole 362 of the printed circuit board 361.

As the resinous insulator 31 is press-fitted from the connecting terminal 43 side of the central conductor 30 equipped with the central contact 32 and the contact piece 33, the hook 49 formed on the central conductor 30 bites into the insulator 31 as shown in FIG. 10(*e*), thus making firm engagement between the central conductor 30 and the insulator 31.

The insertion guide insulator 35 is inserted in the connector main body 1 from the side where the crimped section 3 is formed, then the dummy 36 is inserted and the assembled central conductor 30 is inserted through the inserting hole 362 in the printed circuit board 361.

Figure 7:
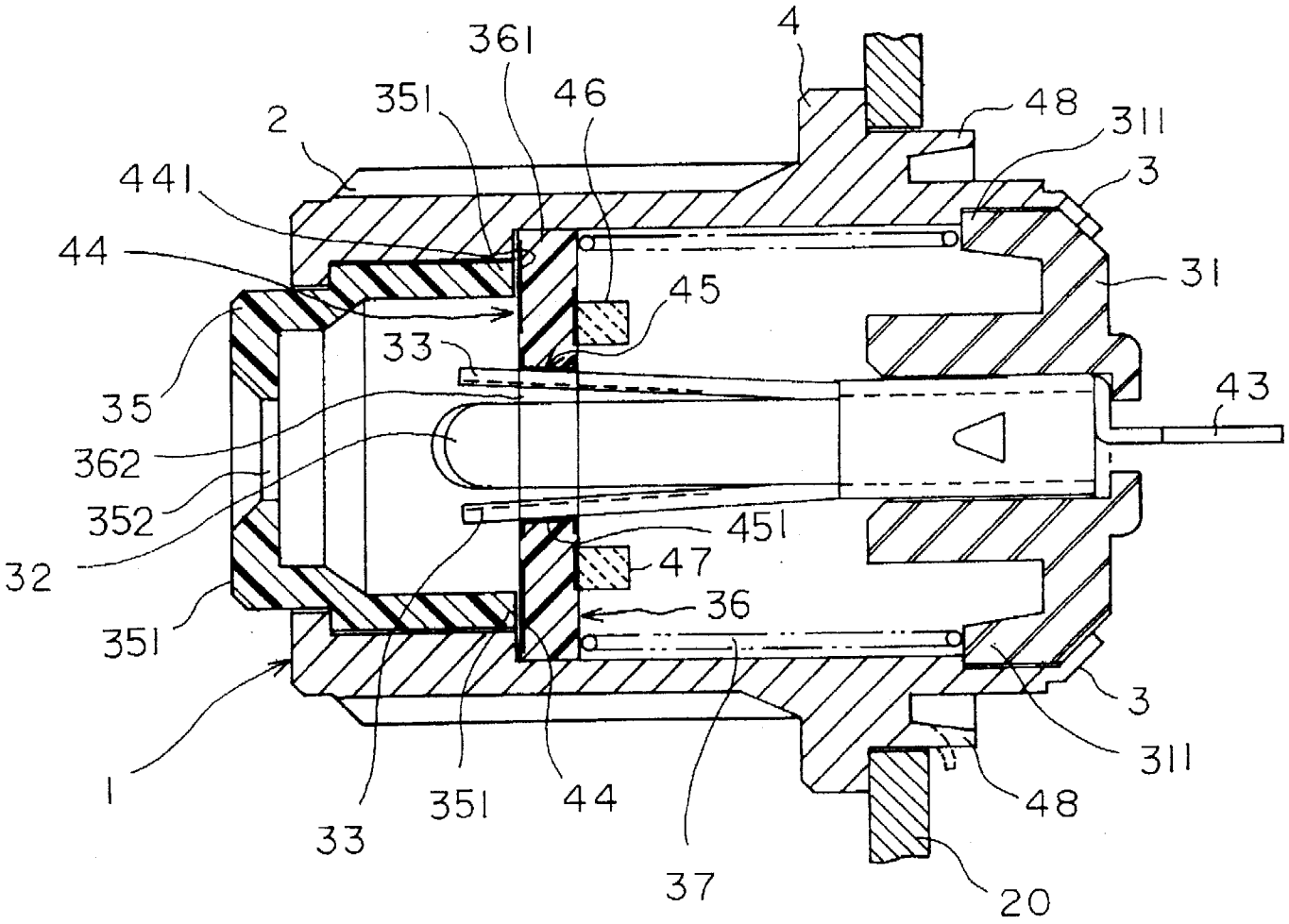
FIG. 7 is a cross-sectional view illustrating the coaxial connector with the built-in terminal in accordance with the second embodiment of the present invention.
Figure 8:
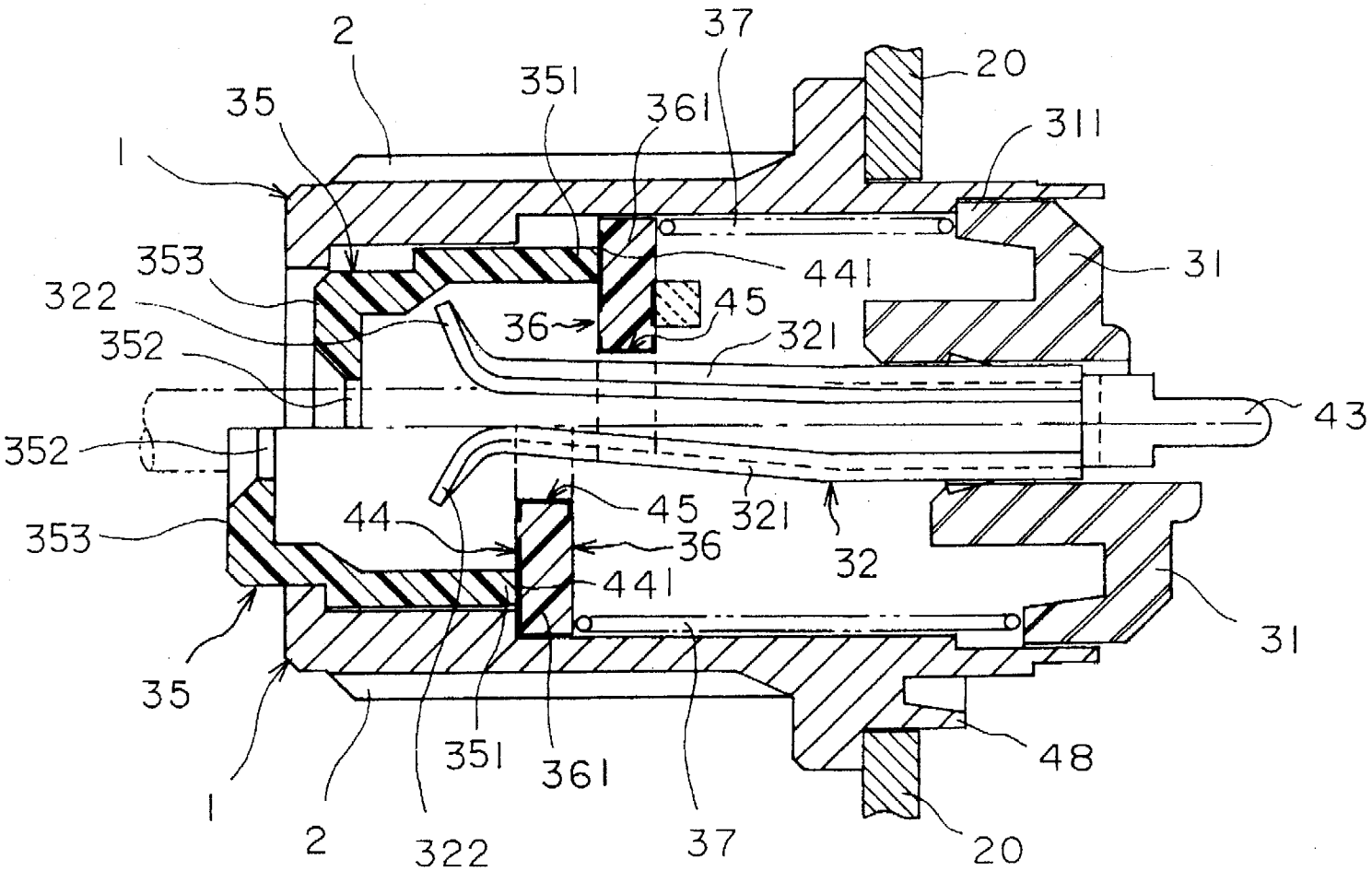
FIG. 8 is a cross-sectional view illustrating the second embodiment according to the present invention observed from a direction which is 90 degrees shifted from that of FIG. 7, the upper half illustrating coaxial plug P attached and the lower half illustrating the blank terminal.

Crimping the section 3 urges the printed circuit board 361 by the spring 37 which is engaged with the distal end 311 of the insulator 31 as illustrated in FIG. 7, thus pressing the printed circuit board 361 against the stepped section 101 (FIG. 9) formed inside the connector main body 1. Further, the front of the insertion guide insulator 35 in contact with the printed circuit board 361 juts out of the connector main body 1. This makes electrical connection between the ground contact section 44 formed on the printed circuit board 361 and the connector main body 1.

Also, the distal end 322 of the central contact 32 is positioned to follow the guiding hole 352 for guiding the central conductor of 510 coaxial plug P' which is formed on the distal end 353 of the insertion guide insulator 35. Further, the contact piece 33 electrically contacts the contact section 45 formed in the insertion hole of the printed circuit board 361.

Thus, when coaxial connector C with the built-in terminal is not provided with coaxial plug P and left as a blank terminal, the central contact 32 is connected to the connector main body 1 via the series circuit of the chip resistor 46 and the chip capacitor 47 soldered to the printed circuit board 361 through the contact piece 33 and the contact section 45.

Coaxial connector C with the built-in terminal is attached to the metallic mounting body 20 of the enclosure or the like of a distributor by crimping the section 48 of the body as illustrated by the dashed line in FIG. 7; therefore, the central contact 32 is terminated with the dummy 36 having the characteristic impedance of the coaxial cable. This prevents the reflection or the entry of external noises which are attributable to coaxial connector C with the built-in terminal.

Figure 9:
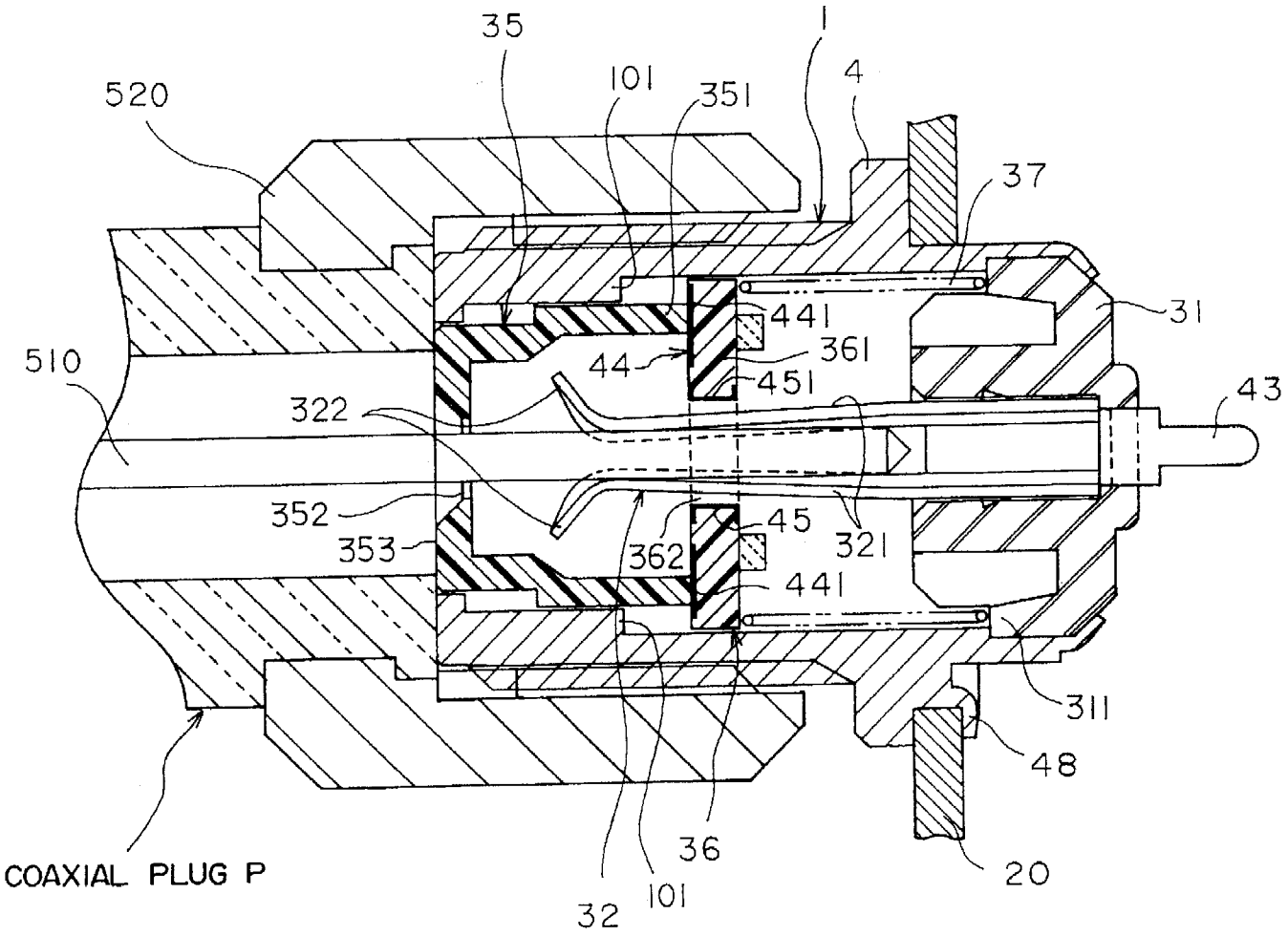
FIG. 9 is a cross-sectional view illustrating the coaxial plug connected to the coaxial connector with the built-in terminal shown in FIG. 8.
Figure 10A:
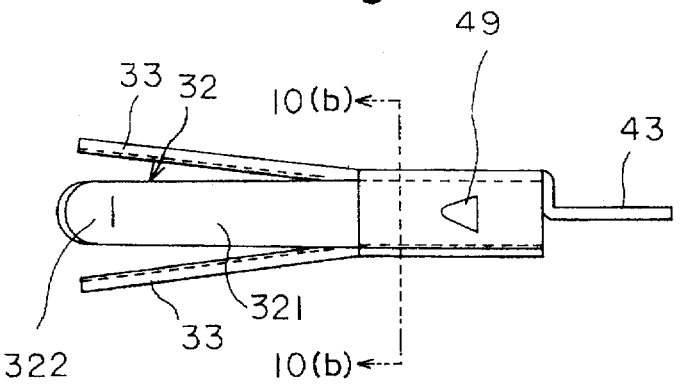
FIGS. 10(*a*)–10(*e*) are diagrams illustrating the details of the central conductor of the coaxial connector with the built-in terminal according to the second embodiment of the present invention.
Figure 10B:
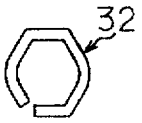
Figure 10C:
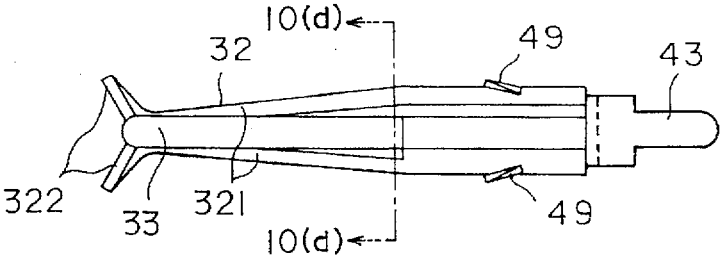
Figure 10D:
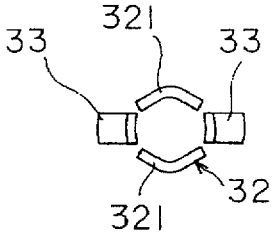
Figure 10E:
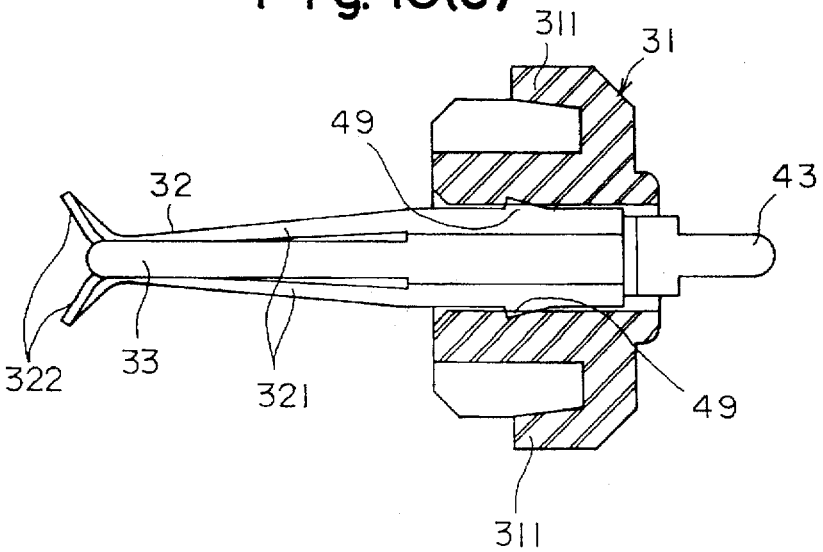

To connect coaxial plug P so as to use coaxial connector C with the built-in terminal left as the blank terminal, the internal thread formed on the inner periphery of the connecting nut 520 of coaxial plug P is screwed to the external thread 2 of coaxial connector C with the built-in terminal as illustrated in FIG. 9. This causes the central conductor 510 of coaxial plug P to be guided by the guiding hole 353 of the insertion guide insulator 35 so that it is inserted in the central contact 32 of coaxial connector C with the built-in terminal, making electrical connection to the central contact 12. Thus, the signals from coaxial plug P are guided to a distributor or the like via coaxial connector C with the built-in terminal.

At the same time, coaxial plug P is brought in contact with the front surface of the insertion guide insulator 35, causing the insertion guide insulator 35 to slide into the connector main body 1.

Thus, the printed circuit board 361 is pushed by the rear end 351 of the insertion guide insulator 35 and slid inside against the spring 37, releasing the contact between the ground contact section 44 formed on the printed circuit board 361 and the connector main body 1. In other words, the central contact 32 is no longer in contact with the dummy 36 comprised of the chip resistor 46 and the chip capacitor 47.

Detaching coaxial plug P from coaxial connector C with the built-in terminal releases the spring 37, which has been compressed and displaced, and the released spring 37 in turn releases the printed circuit board 361 and the insertion guide insulator 35. This causes the ground contact section 44 of the printed circuit board 361 and the connector main body 1 to come into contact again, with the consequent blank terminal terminated with the aforesaid dummy 36.

It should be noted that the electrical contact between the contact piece 33 and the contact section 45 formed on the printed circuit board 361 is maintained even when the printed circuit board 361 is slid in.

As previously stated, the central contact 32 is comprised of two elastic strips 321 facing against each other and bent in cross section. This feature makes it possible to accommodate various diameters of the central conductor of coaxial plug P to be attached. Hence, as in the first embodiment, the second embodiment is also adaptable to the central conductor of a coaxial plug P having a diameter of about 0.5 mm to about 1.5 mm.

When the central conductor of a coaxial cable is employed for the central conductor of coaxial plug P, the projecting length of the central conductor varies with the seasonal expansion and contraction or machining accuracy of the coaxial cable. In the second embodiment, however, nothing is provided in the central contact 32; therefore, such variations in the projecting length can be accommodated (compatible with a central conductor of up to 13.5 mm in length).

Figure 11A:
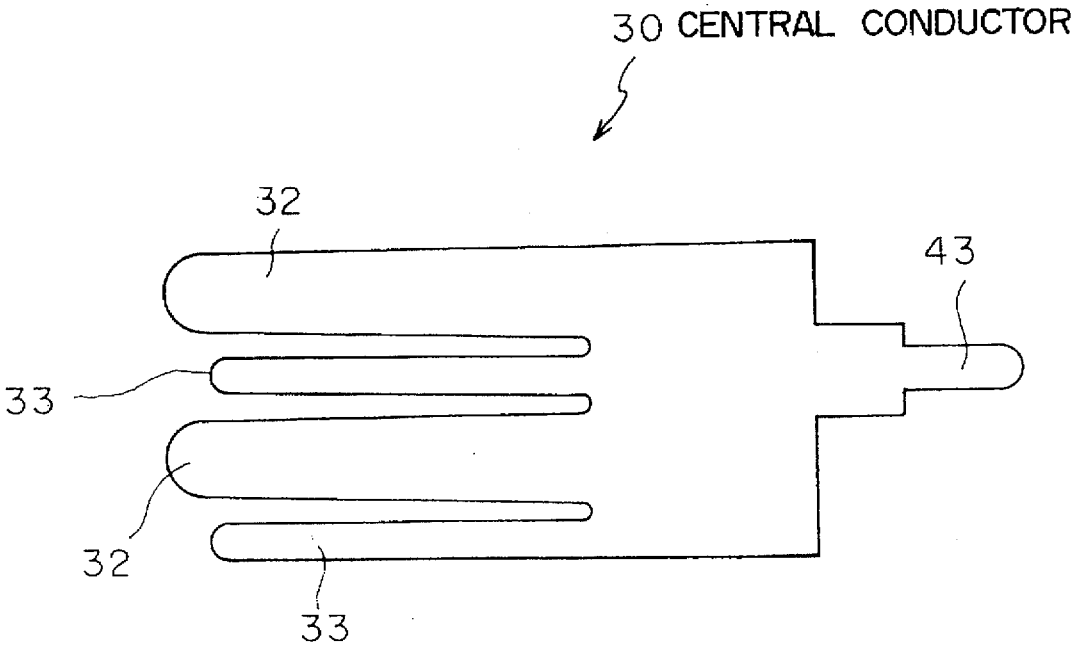
FIGS. 11(*a*)–11(*b*) are diagrams for illustrating the sheeting work for manufacturing the central conductor of the coaxial connector with the built-in terminal according to the second embodiment of the present invention.
Figure 11B:
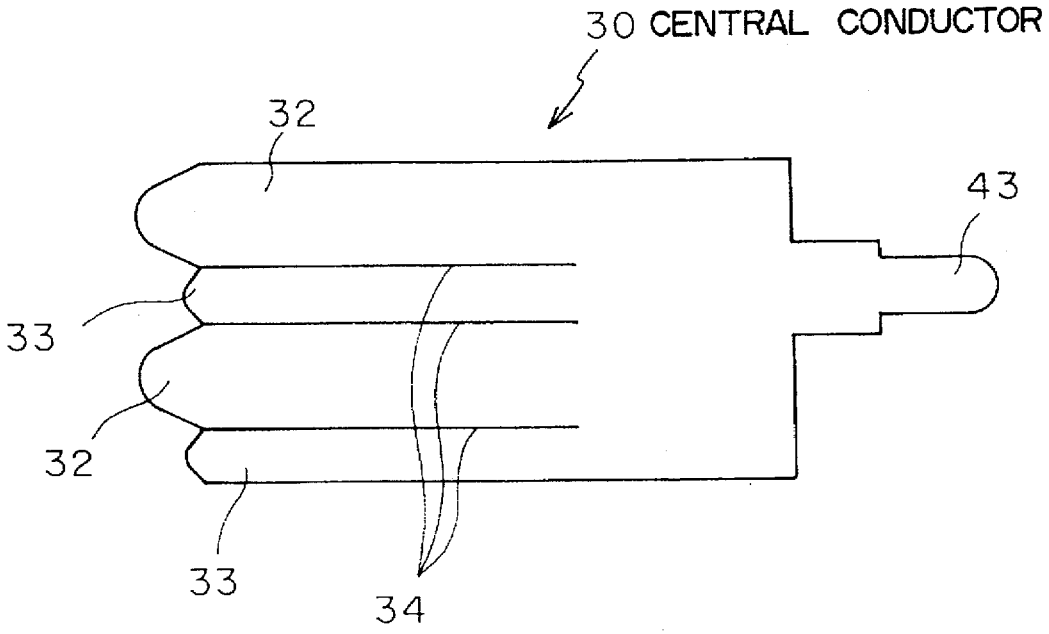
Figure 12A:
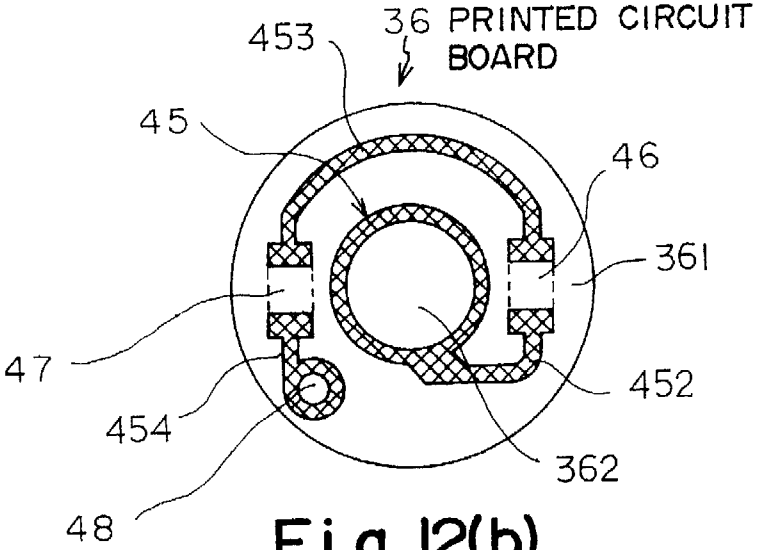
FIGS. 12(*a*)–12(*d*) are diagrams illustrating the detailed configuration of the printed circuit board of the coaxial connector with the built-in terminal according to the present invention.
Figure 12B:
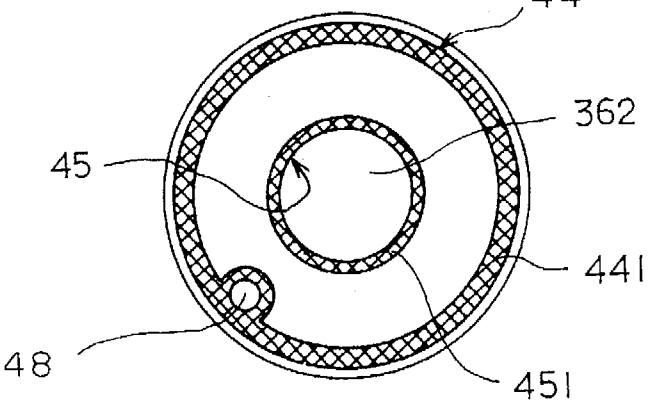
Figure 12C:
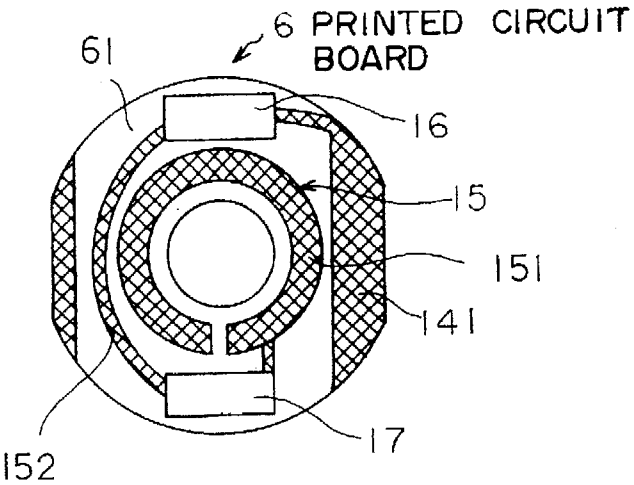
Figure 12D:
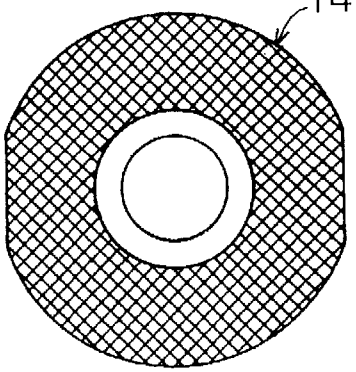
Figure 13:
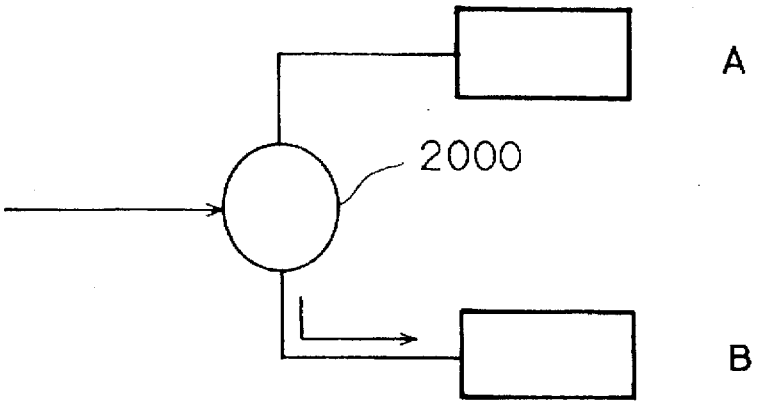
Fig. 13 Prior art
FIG. 13 is a prior art diagram for illustrating connected household equipment in a CATV system.
Figure 14:
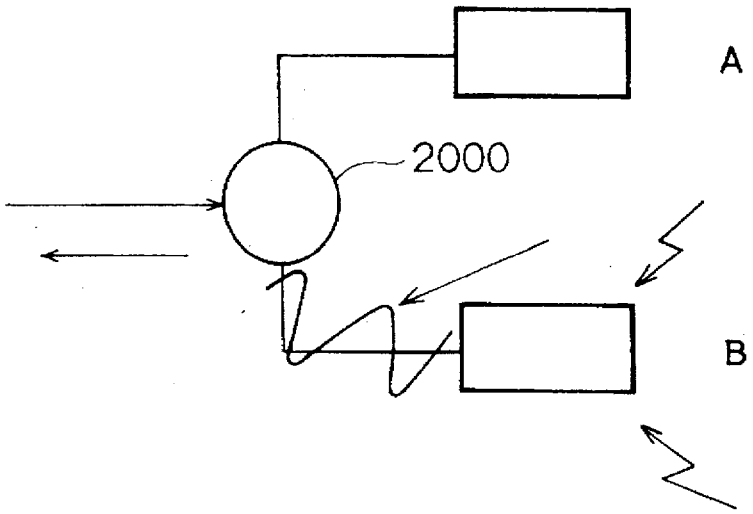
Fig. 14 Prior art
FIG. 14 is a prior art diagram for illustrating connected household equipment in a bilateral CATV system.

Furthermore, the central conductor 30 in the second embodiment can be easily made by pressing and bending. FIG. 11(*a*) and (*b*) show the shapes of the central conductors which have been punched. The central conductor 30 shown in FIG. 11(*a*) is fabricated by forming the central contacts 32 and the contact pieces 33 alternately and then bending them.

The central conductor illustrated in FIG. 11(*a*) may be too small to fabricate by pressing; in such a case, the shape shown in FIG. 11(*b*) is used for pressing. In the latter case, slits 34 are provided between the central contacts 32 and the contact pieces 33 before bending them to fabricate the central conductor 30.

At the time of pressing, the cross section shape of the contact piece 33 may be rounded to match the contour of the inserting hole 362 of the printed circuit board 361.

The detailed configurations of the printed circuit boards 61 and 361 are illustrated in FIG. 12.

As shown in FIG. 12(*c*) and (*d*), the disc-shaped printed circuit board 61 has the ground contact section 14 made of a copper foil covering one entire surface thereof and a printed line 141, 151, 152 formed on the other surface thereof. The chip resistor 16 and the chip capacitor 17 are surface-mounted on the printed line 141, 151, 152 so that they face against each other and they are connected in series through the printed line 141, 151, 152. The printed circuit board 61 also functions as a shield plate, so that the ground contact section 14 is shielded from external noises and the like.

As shown in FIG. 12(*a*) and (*b*), the printed circuit board 361 has the annular ground contact section 44, which is made of a copper foil, on one surface of the disc-shaped printed circuit board 361. A through hole 48 is formed in the ground contact section 44 for making the connection with the printed line 454 formed on the other surface. The copper foil 45 in the through hole of the inserting hole 362 formed at the center is connected with the printed line 452 formed on the other surface. The chip resistor 46 and the chip capacitor 47 are connected in series through the printed line 452, 453, 454. The printed line 454 has the through hole 48 for making the connection to the ground contact section 44 formed on one surface.

Figure 15:
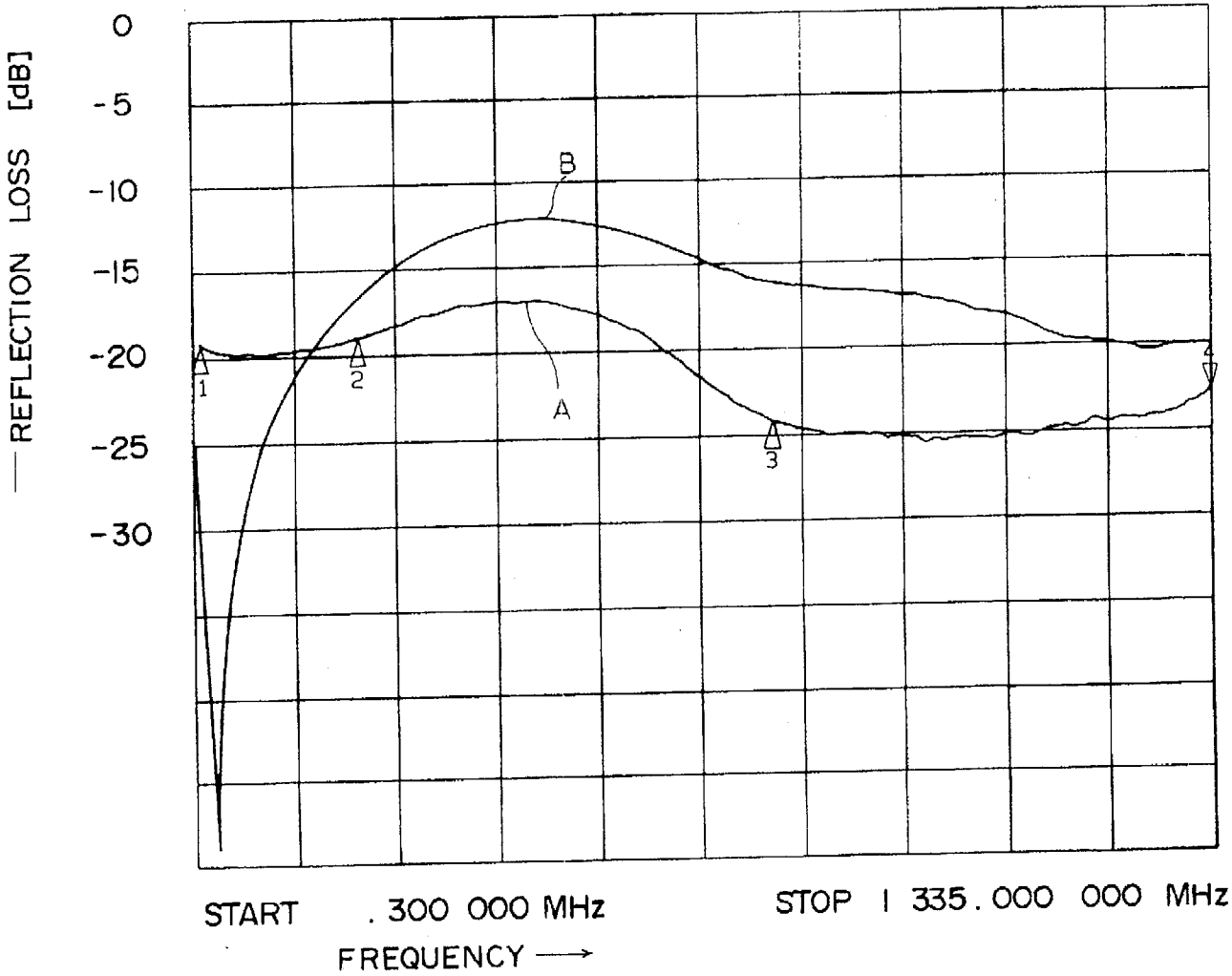
FIG. 15 is a chart showing the characteristic curve observed when the output terminal of a series unit is left as a blank terminal and the characteristic curve observed when it is terminated with a dummy resistor.

Although the connector main body 1 of the coaxial connector with the built-in terminal according to the first and second embodiments of the present invention contains metallic components such as the printed circuit board 61 or 361 and the springs, the electrical characteristics thereof including VSWR do not show deterioration. The reflection characteristic of the coaxial connector with the built-in terminal according to the present invention is as indicated by curve A of FIG. 15 and it is as good as that obtained when the coaxial connector is terminated with the separate dummy plug 01 as in the conventional case.

Figure 16:
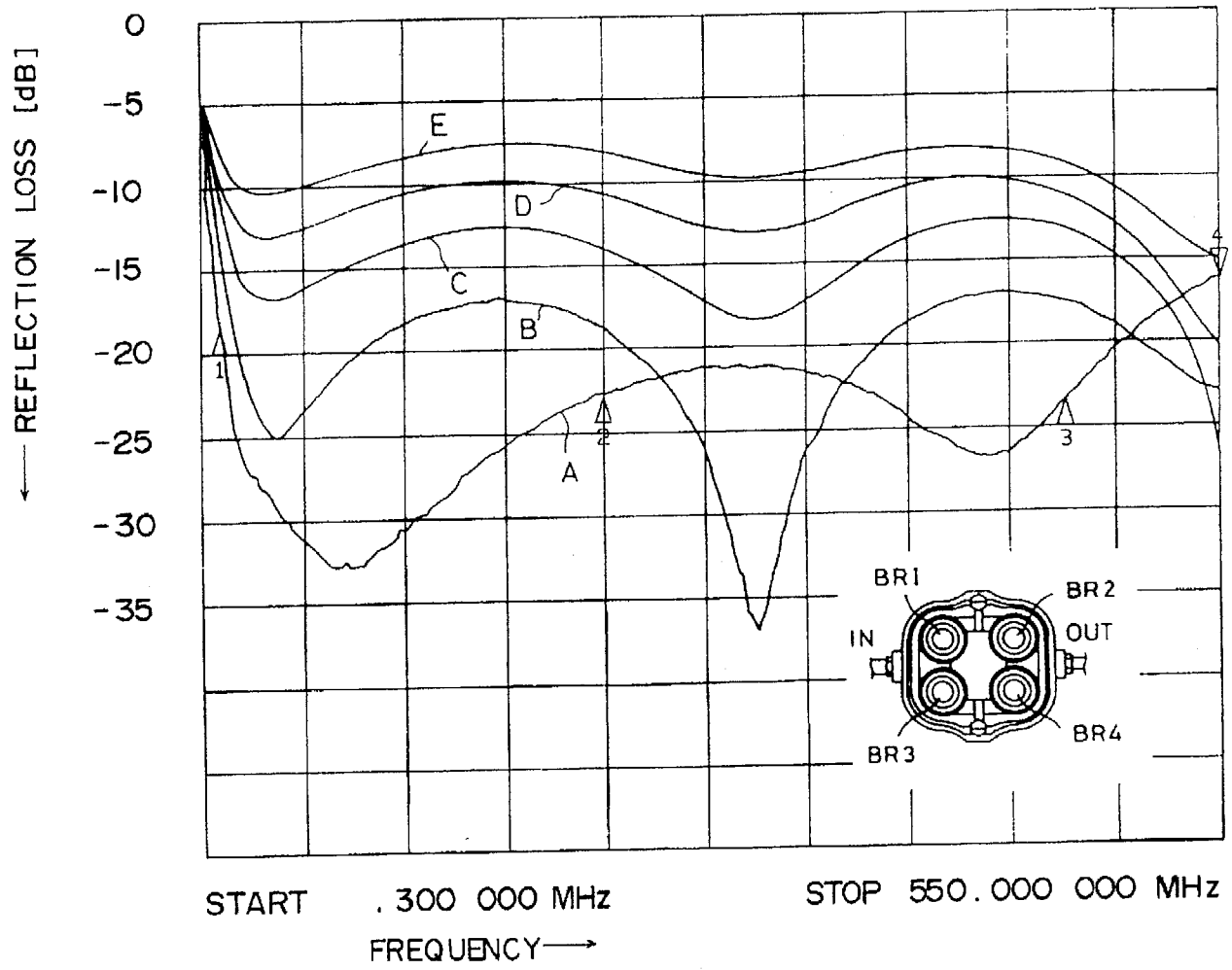
FIG. 16 is a chart showing the reflection loss curves observed when the output terminals of a four-branch tap are left as blank terminals and the reflection loss curves observed when they are terminated with dummy resistors.
Figure 17:
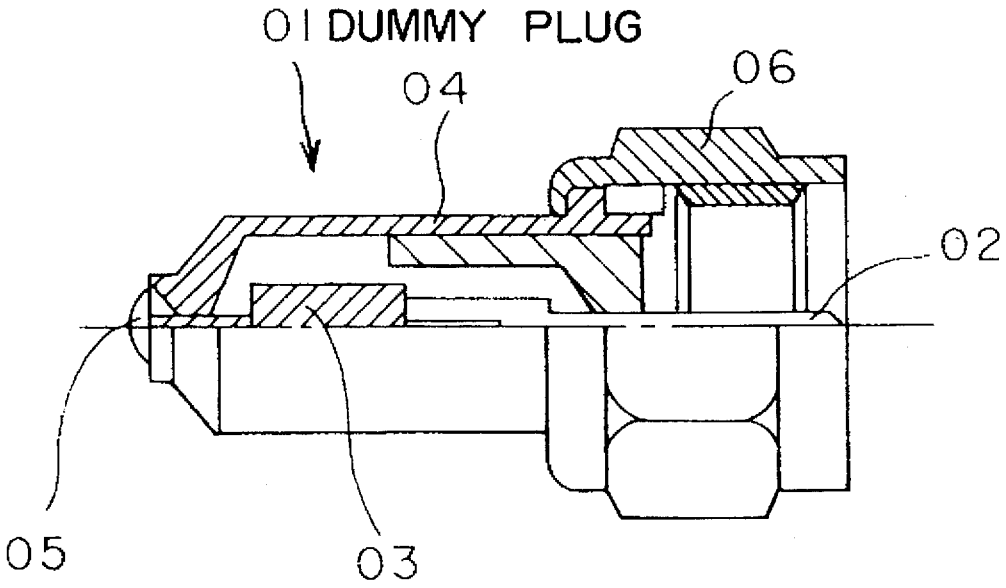
Fig. 17 Prior art
FIG. 17 is a cross-sectional view illustrating a conventional prior art dummy plug which is partially cut off.

The reflection characteristic obtained by using the coaxial connector with the built-in terminal for the four-tap-off has exhibited improvement as indicated by curve A of FIG. 16. This proves that the present invention improves the quality of transmission signals without the need of providing a blank terminal with a dummy plug as in the past.

In the above description, the resistance value of the small chip resistors 16 and 46 was set to 75 ohms; the resistance value is generally set to 75 or 50 ohms to match the characteristic impedance of a coaxial cable. The small chip capacitors 17 and 47 mounted on the printed circuit boards 61 and 361, respectively serve to remove DC voltage from the signals transmitted through a coaxial cable; therefore, the chip capacitors 17 and 47 may be omitted if no DC voltage is involved. Furthermore, in the description given above, the coaxial connector with the built-in terminal is attached to a distributor; however, it may be attached to a branching filter or other equipment for transmitting electric signals.

In addition, at least one of the parts composing the switch of the coaxial connector is annular and it is disposed to face against the other, thereby ensuring that a contact is brought into electrical engagement with a contacting section at some point even if the printed circuit board is somewhat tilted from the vertical position thereof.

Since the present invention is designed as stated above, when a coaxial connector is not provided with a coaxial plug, an electric signal entering the central contact is terminated at the electrical circuit of the printed circuit board via the central contact. The electric circuit is provided with a dummy, so that the electric signal passes through the dummy to be transmitted to the connector main body of the coaxial connector before it is grounded. Hence, even if the coaxial connector becomes a blank terminal, the reflection of the electric signal, which has been applied to the central contact, can be prevented and it is also possible to prevent the central contact from picking up external noises.

Moreover, when a coaxial plug is attached to the coaxial connector with the built-in terminal in accordance with the present invention, the coaxial connector is capable of maintaining as good electrical characteristics as those of the conventional coaxial connector despite that it contains a printed circuit board with a dummy and the like and a device for turning ON/OFF the dummy.

Furthermore, the connector main body is made cylindrical and it has a stepped section for holding the printed circuit board, so that one end of the ground contact of the electric circuit of the printed circuit board, which is inserted and disposed in the connector main body, is brought into direct contact with the stepped section of the connector main body. This structure eliminates the need of such components as a ground spring for the grounding between the electric circuit of the printed circuit board and the connector main body, leading to a reduced number of assembly man-hours and fewer components.

What is claimed is:

1. A coaxial connector with a built-in terminal comprising:

a substantially cylindrical connector main body shaped to receive a coaxial plug;

a central contact in said connector main body for receiving electrical signals;

an insulator which fixes said central connector to the said connector main body in such a manner that said central contact is located on approximately a central axis of said connector main body;

a dummy comprising a printed circuit board located within the said connector main body, said central contact being fitted into an inserting hole which is formed substantially in the center of said printed circuit board, said printed circuit board oriented at substantially right-angles to said central axis of the said connector main body, a contact provided on the said printed circuit board, and an electrical element;

a switch terminal block located within the said central contact, said switch terminal block being capable of movement along the central axis of the said central contact; and an elastic member located within said central contact in such a manner as to terminate the said central contact with the aid of the said dummy by energizing the said switch terminal block so as to bring a projection of said switch terminal block into electrical engagement with said contact on said printed circuit board;

the said elastic member being compressed by a central conductor of a coaxial plug, when a said coaxial plug is inserted into the said connector main body, in such a manner that the said switch terminal block is moved to interrupt electrical engagement between said contact of said printed circuit board and said switch terminal block.

2. A coaxial connector with built-in terminal according to claim 1 wherein conductive foil covers a surface of the said printed circuit board to provide a ground contact section on said printed circuit board which also functions as a shield.

3. A coaxial connector with built-in terminal according to claim 2 wherein said printed circuit board is held within the said connector main body between a stepped section formed on an inner surface of the said connector main body and a distal end of the said insulator, said ground contact section on said printed circuit board being in electrical contact with the said stepped section.

4. A coaxial connector with a built-in terminal comprising:

a substantially cylindrical connector main body shaped to receive a coaxial plug;

a central contact in said connector main body for receiving electrical signals;

an insulator which fixes said central contact to said connector main body in such a manner that said central contact is located on approximately a central axis of said connector main body;

a dummy comprising a printed circuit board having an inserting hole formed substantially in the center of said printed circuit board, said central contact being fitted into said inserting hole, said printed circuit board being oriented at substantially right-angles to said central axis of the said connector main body, a contact provided on the said printed circuit board, and an electrical element;

a contact piece located on said central contact for electrical engagement with a contact section formed in said inserting hole of the said printed circuit board;

an elastic member which serves to terminate said central contact with the aid of the said dummy by energizing said printed circuit board, said printed circuit board being capable of sliding motion substantially along the central axis of the said connector main body in such a manner as to bring a ground contact section of said printed circuit board into electrical contact with a stepped section formed on said connector main body; and an insertion guide insulator located in a sliding fashion within the said connector main body in such a manner that a distal end of said insertion guide insulator protrudes from said connector main body while a trailing end of said insertion guide insulator is brought into contact with said printed circuit board;

said coaxial connector being so configured that insertion of a coaxial plug into said connector main body causes said printed circuit board and said insertion guide insulator to slide within said connector main body to sever the electrical contact between said ground contact section of said printed circuit board and the said stepped section of the said connector main body.

* * * * *